United States Patent [19]

Jönsson

[11] 4,345,913

[45] Aug. 24, 1982

[54] METHOD AND APPARATUS FOR DETERMINING THE LIGNIN CONTENT IN PULP

[75] Inventor: Ann-Sofi Jönsson, Genarp, Sweden

[73] Assignee: Eur-Control Källe AB, Sweden

[21] Appl. No.: 225,134

[22] Filed: Jan. 14, 1981

[30] Foreign Application Priority Data

Jan. 18, 1980 [SE] Sweden ..... 8000434

[51] Int. Cl.[3] ..... G01N 25/20

[52] U.S. Cl. ..... 23/230 R; 162/49; 162/61; 162/62; 422/68; 422/78

[58] Field of Search ..... 23/230 R; 422/68, 78, 422/51; 162/49, 61, 62

[56] References Cited

U.S. PATENT DOCUMENTS 3,272,691 9/1966 Shera ..... 162/49 X 3,888,726 6/1975 Hultman ..... 162/62 X 4,042,328 8/1977 Seymour ..... 162/49 X 4,162,933 7/1979 Sherman ..... 162/61 X

OTHER PUBLICATIONS

Chemical Abstracts, 71:31553c, (1969).

*Primary Examiner*—Sidney Marantz

*Attorney, Agent, or Firm*—Ostrolenk, Faber, Gerb & Soffen

[57] ABSTRACT

A method and a device for determining the lignin content in pulp by measuring the temperature increase on chlorination of a pulp sample with well-defined moisture content. The pulp sample is dewatered by pressing and simultaneously being blown through by a gas having low oxidization activity, subsequent to which the maximum temperature increase is registered when the pulp sample is blown through by chlorine gas.

9 Claims, 8 Drawing Figures

Figures 1, 2, 3, 4, 5, 6, 7, 8:
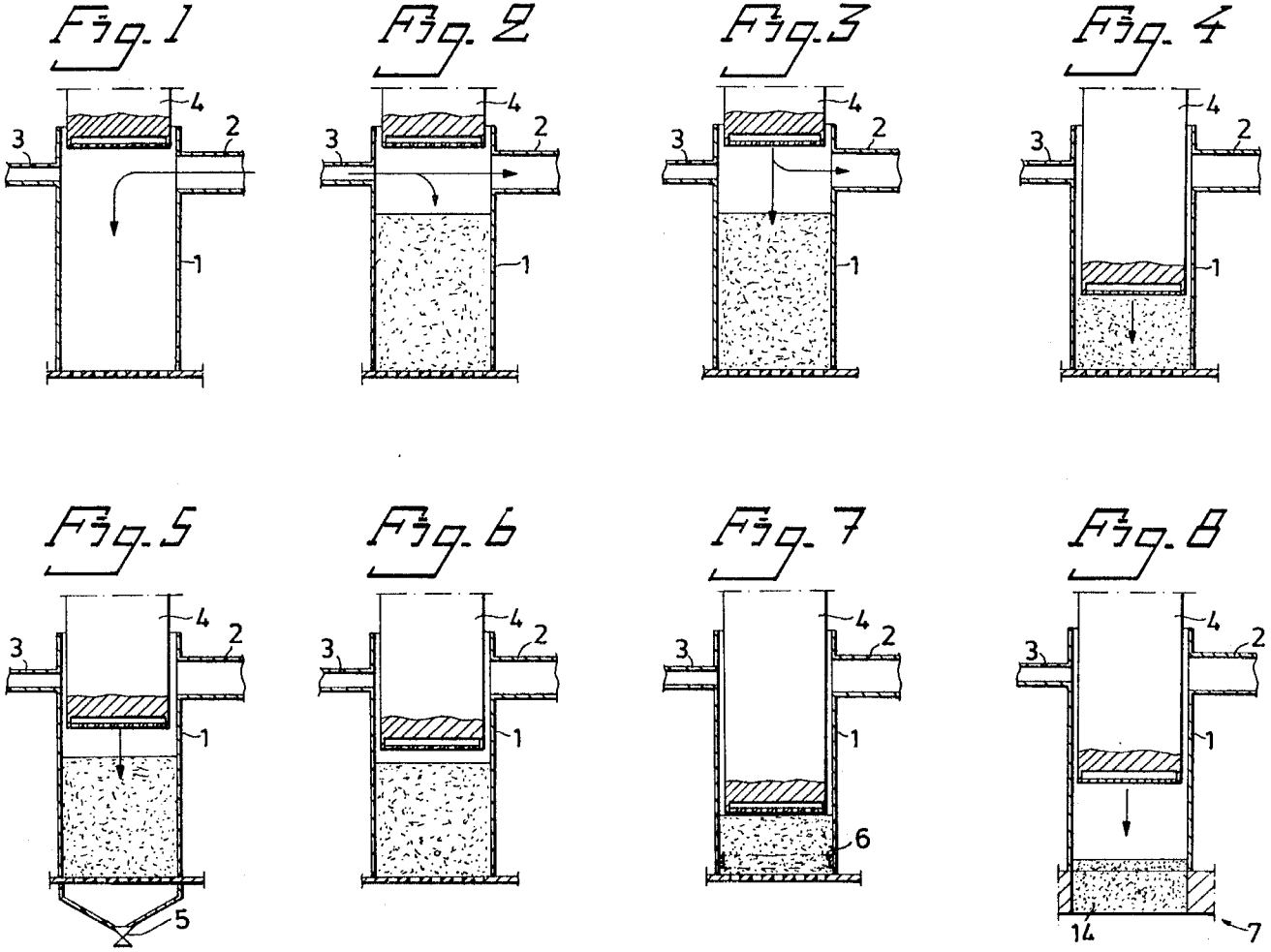

1
2
3
4
5
6
7
14

METHOD AND APPARATUS FOR DETERMINING THE LIGNIN CONTENT IN PULP

The invention relates to a measuring apparatus for determining lignin content of a fibre raw material, preferably wood, treated with chemicals for paper manufacturing or similar applications.

In producing cellulose fibres for the manufacture of paper, cardboard, carton etc. a fibrous raw material, e.g. wood chips, is treated with chemicals at increased pressure and temperature, parts of the intercellular bondings being weakened by partial removal of hemicellulose and lignin, followed by mecanical treatment to separate the individual fibres. Since fibre quality, the aspect of production costs, subsequent treatment of the fibres, e.g. bleaching, and the effect of the mill on the environment are heavily affected by the lignin content, it is an obvious desire to keep the lignin content within narrow limits. This requires a process control, which is often very advanced, with both feed-back and feed-forward due to large dead times and time constants.

Independently of how the general process control is carried out, a final check on the result of the pulping process is necessary. Today, this is done manually, which is either costly or, if fewer tests are made, less reliable. To overcome this difficulty, several attempts have been made to provide a continous meter for routine determination of lignin. However, no practically functioning instrument has so far been taken into operation. One such instrument is a meter developed by O'-Meara Co in the U.S. This is based on the fact that a yellow substance extracted from pulp upon reaction with hot nitric acid has an extinction maximum, and that the intensity at this wavelength is a direct function of the lignin content of the pulp. The light absorbance is measured and the lignin content is calculated from the actual sample weight and the absorbance value. Other devices are conceived as pure automation of laboratory methods of determination, such as Kappa number measurement by permanganate titration.

The disadvantages with the proposed devices, and in some cases those which have been tested in prototype, is that they work on the batch principle with long intervals between samples, and as a result deviations in the lignin content intervals of hours or less are difficult to detect. The difficulty accompanying the practically executable manual method thus remains.

There are further disadvantages, such as the great need of accurately prepared sample solutions, careful determination of the sample amount, measuring signals, large service requirements etc.

The present invention solves the above-described problems by determining the lignin content of a fibre cake which has been formed and pressed to a consistent dry content by being blown through with a gas, while being compressed by a mechanically applied force, followed by a determination of the lignin content by measurement of the temperature increase in said cake when chlorine gas is passed through it.

It is known that chlorine reacts exothermically with lignin. It is also known that there is a linear relationship between chlorine consumption and the total lignin content in a sample. It is further known that in chlorination of unbleached sulphate cellulose, the generated reaction heat causes a temperature increase which is proportional to the lignin content for a defined moisture content of different pulps. Still further, it is known that compression at a specified pressure gives a specified moisture content in different pulps.

The method in accordance with the present invention is characterized in that the moisture content of a diluted sample is decreased by means of pressure and simultaneous blowing-through of a gas, followed by a penetration of gaseous chlorine into the sample. The temperature increase in the sample is registered and constitutes a measure of the lignin content.

The method in accordance with the invention is further characterized by the compressing of the sample at a specified pressure, and by this method there is obtained a constant moisture content for different samples. By this method, the temperature increase during the chlorination is independent of the sample quantity.

The method in accordance with the invention is further characterized in that compression of the sample takes place during simultaneous blowing through of the gas. By this method, the specified moisture content is obtained more rapidly, while the porosity of the sample increases, which facilitates penetration of the sample by the chlorine gas.

In the inventive method, the chlorine gas penetrating the sample is at an excess pressure, which increases the reaction speed and thereby enables a more rapid measurement.

The inventive method is also preferably carried out in an automatic apparatus.

The inventive method will now be described in detail while referring to the accompanying schematic drawings.

FIGS. 1–8 show the automatic apparatus of the present invention through the various stages of the inventive method.

The sample, in the form of a diluted pulp suspension e.g. with a consistency of pulp of 0.1%, in which the lignin content is to be determined, is sucked into a cylinder 1, e.g. by means of a water jet injector not shown on the drawing, via a conduit 2, FIG. 1. After 2 minutes, when a suitable sample quantity, e.g. a quantity corresponding to 10 grams of dry pulp, has been sucked into the cylinder 1, water is flushed in from a conduit 3 during a second or so through the upper part of the cylinder and out through the conduit 2, so that there are no particles in the upper part of the cylinder which could obstruct compression, and simultaneously washing of the pulp is obtained, (FIG. 2). A gas, e.g. air, is blown in via a valve 9 (see FIG. 9) and via a piston 4 through the upper portion of the cylinder 1, so that the pulp in the conduit 2 is flushed back, see FIG. 3.

Compression takes place 30 seconds after air has been sucked through the sample. A compressed air cylinder 8 (see FIG. 9) presses the piston 4 down in the cylinder 1. The sample is compressed, e.g. at a pressure of 1.3 MPa (1 MPa=10.2 kg/cm$^2$=745 psi), the air blown through the sample being adapted to this pressure, see FIG. 4. A suction pump (not shown) is closed after 5 minutes.

After 4 minutes of compression, the air blown-through is broken off, and the pressure in the compressed air cylinder 8 is decreased so that when a chlorine gas valve 10 (see FIG. 9) is opened, decompression of the sample takes place. Some seconds after the chlorine gas valve 10 has been opened, a valve 5 is closed in the bottom of the cylinder 1 so that no chlorine gas is forced out, see FIG. 5.

Since chlorine is consumed during the reaction, the pressure above the sample decreases and the piston 4 is pressed down until the chlorine gas pressure once again corresponds to the pressure on the piston 4, see FIG. 6.

Some seconds after the chlorine gas valve 10 has been closed, the valve 5 is opened, and after some further seconds, the pressure on the piston 4 is increased to its original value. By this compression of the sample, the thermal contact between sample and temperature measurement means is increased, see FIG. 7.

The temperature increase of a ring 6, made from silver for example, in the lower portion of the cylinder 1 is measured with the aid of thermoelements.

Figure 9:
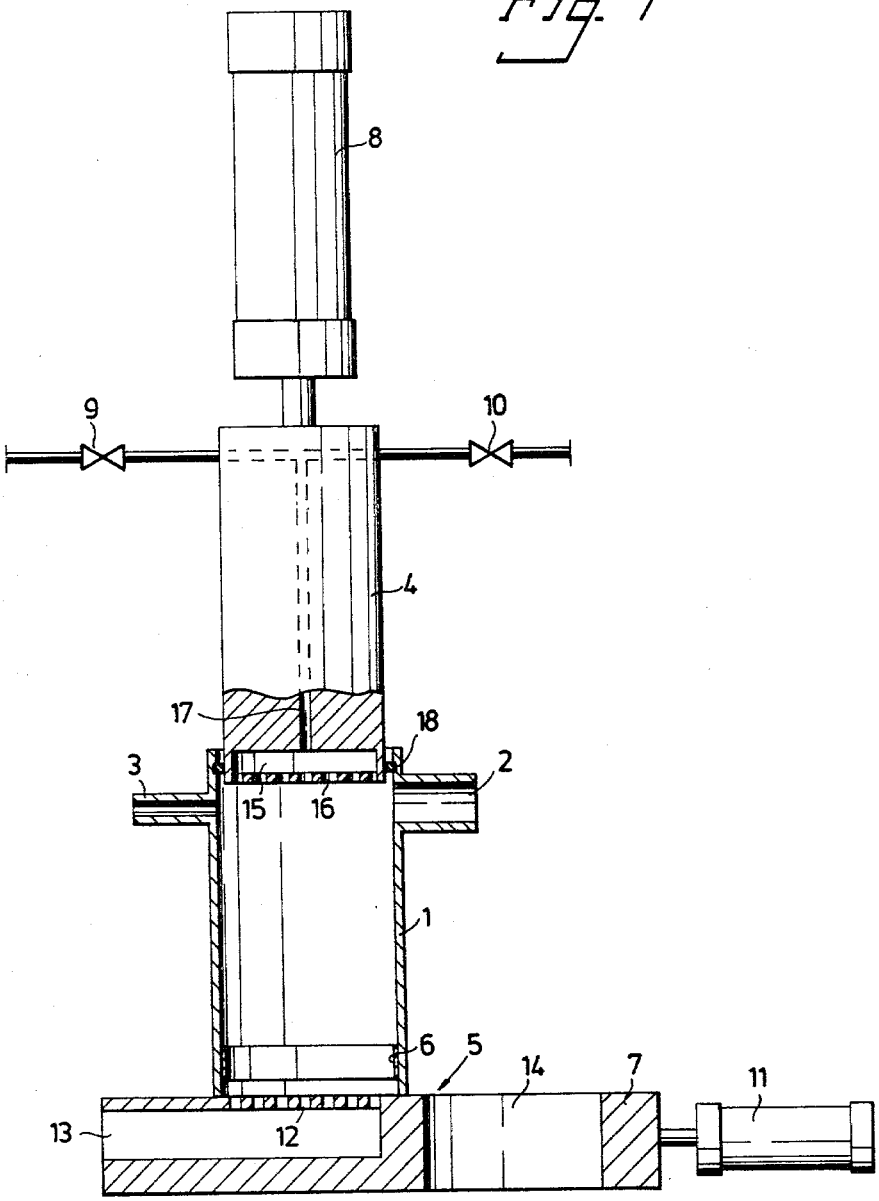

Compression is broken off and the sample is removed by displacing a plate 7 by means of a compressed air cylinder 11, the piston being forced downwards and air, for example, ejects the sample through a hole 14 in the movable plate 7, see FIGS. 8, 9.

When the movable plate 7 is in the end position depicted in FIG. 9, a strainer 12 formed in the bottom of the plate 7 forms the bottom of the measuring cell 1. Under this strainer 12 there is a cavity 13 formed in the plate 7 for leading away excess water and gas. A channel 17 extends through the piston 4, and opens out into the measuring cells 1, via a cavity 15 and strainer 16 arranged in the bottom of the piston 4. The piston 4 is sealed against the measuring cell by means of a sealing ring 18 and the measuring cell 1 is suitably connected gastight to the plate 7.

I claim:

1. A method for determining the lignin content in a pulp sample comprising:

(a) compressing the pulp sample to dewater same while simultaneously blowing gas of substantially no reactive capacity with regard to the lignin through the pulp sample, whereby a dewatered product of a definite low moisture content is obtained, (b) blowing chlorine gas through the dewatered product resulting from (a), and (c) measuring the maximum temperature rise resulting from (b).

2. A method as in claim 1 wherein the pressure of gas of substantially no reactive capacity being blown through the pulp sample is adjusted to that of the compressing pressure.

3. A method as in claim 1 further comprising water washing the pulp sample prior to step (a), the temperatures of the pulp sample and the washing water being adjusted to the same temperature of a measuring device where the temperature rise is measured.

4. A method as in claim 1 wherein the gas of substantially no reactive capacity is air.

5. A method as in claim 1 wherein the compressing pressure is between 0.1 to 10 MPa.

6. A method as in claim 5 wherein the compressing pressure is 1.6 MPa.

7. A method as in claim 1 wherein the pressure of the chlorine gas is between 0.1 and 2.5 MPa.

8. A method as in claim 7 wherein the pressure of the chlorine gas is 0.7 MPa.

9. Apparatus for carrying out the method in accordance with claim 1, and comprising a gastight measuring cell in which there is arranged a piston displaceable in the cell with the aid of a compressed air cylinder (4), characterized in that the piston (4) is provided with a channel (1) opening out in the measuring cell (1), through which channel air and chlorine gas are introducible into the measuring cell via valve means and that the measuring cell comprises in addition to a metal ring at the lower part of the measuring cell to sense the temperature of the pulp sample therein, a strainer plate formed in a movable plate with a cavity underneath, through which water and gas excess can be led off, at one end position said plate forming with its strainer plate the bottom of the measuring cell, and its other end position enabling blowing out of the pulp sample via a hole.

* * * * *